US005435662A

United States Patent [19]

Brown et al.

[11] Patent Number: 5,435,662

[45] Date of Patent: Jul. 25, 1995

[54] METHOD AND DEVICE FOR MARKING PAINT STRIPS AND MAINTENANCE COVERS WHEN RESURFACING STREETS

[76] Inventors: Donald M. Brown, 440 S. Arden Blvd., Los Angeles, Calif. 90020; Michael P. Manion, 858 3rd. Ave., Los Angeles, Calif. 90005

[21] Appl. No.: 124,080

[22] Filed: Sep. 21, 1993

[51] Int. Cl.[6] ..... E01F 9/012

[52] U.S. Cl. ..... 404/9; 404/72; 404/75; 404/93; 404/26; 116/63 C; 116/63 P

[58] Field of Search ..... 404/26, 10, 12, 48, 404/75, 84.1, 93, 72; 116/63 C, 63 P

[56] References Cited

U.S. PATENT DOCUMENTS

| | | | |
|---|---|---|---|
| 2,817,308 | 12/1957 | Scanlon | 116/63 C |
| 2,954,005 | 9/1960 | Cioffi et al. | 116/63 |
| 5,195,841 | 3/1993 | Mullins | 404/72 |
| 5,199,814 | 4/1993 | Clark et al. | 404/10 |

*Primary Examiner*—David J. Bagnell

*Assistant Examiner*—Pamela O'Connor

*Attorney, Agent, or Firm*—John T. Matlago

[57] ABSTRACT

Marker devices, each comprising a base with an upright post thereon, are molded from an elastomeric material. A marker device is attached by adhesive on the base thereof to each paint striping on a worn down street and each maintenance cover mounted on the worn down street. Once the marker devices are in place on the worn down street, the posts thereof must withstand the punishment of not only being flattened by truck tires, and the tracts of a paving machine that is being used to lay down the new coating of hot asphalt on the worn down street, but also the hot asphalt, and still spring back to their upright position. Thus, when the stripings are to be repainted on the resurfaced street and when the maintenance covers are to be adjusted upwardly to the level of the new coating of asphalt on the resurfaced street their exact locations on the street are immediately indicated by the posts of the marker devices without having to make any measurements.

7 Claims, 4 Drawing Sheets

METHOD AND DEVICE FOR MARKING PAINT STRIPS AND MAINTENANCE COVERS WHEN RESURFACING STREETS

This invention relates to a marker device for use when resurfacing streets, and more particularly to a marker device for identifying the locations of stripings and metal covers on a street after it has been resurfaced.

BACKGROUND OF THE INVENTION

At the present time, procedures for resurfacing streets with a coating of asphalt usually require that the worn down old surface on the street be scraped over to roughen it and remove the loose material thereon. A new coating of asphalt is then laid down over the entire surface of the street to a level of one or more inches above the old surface.

There is a problem in the resurfacing of the street in that the stripings of paint that define the center and lanes on the street and the maintenance covers that are mounted flush with the surface of the worn down street are covered over by the new coating of asphalt. Thus, in order to determine the exact location of where the stripings should be repainted on the surface of the new coating of asphalt, it has been the practice to use three crewmen, one holding the ends of a line at each curb and one holding the line at the center of the street or at the lane divisions thereof to mark the exact locations of the center and lane stripings on the new surface. These marks are usually spaced from each other along the street by as much as 200 feet. In order to determine the exact locations of the maintenance covers that are located on the worn down street, prior to laying down the new coating of asphalt thereon, it has been the practice for contractors, utility companies and municipal agencies to send out crewmen to provide a mark on the curb of the street opposite each of the maintenance covers. The crewmen then further measure the distance that each maintenance cover is located from the curb and place this information adjacent each of the marks on the curb. Then, after the street has been resurfaced with a new coating of asphalt, the crewmen must return to again measure the distance from each mark on the curb and place a spot of paint on the resurfaced street which corresponds to the location of each of the maintenance covers now embedded below the new coating of asphalt. The asphalt coating above each of the maintenance covers is then removed by crewmen using a shovel or a pick ax, depending on whether the fresh asphalt has had time to harden. Each of the maintenance covers is then lifted out of its opening and an expandable cylindrical spacer which is held in a cylindrical opening in the base of the street and serves to support the maintenance cover is then adjusted so that when the maintenance cover is placed back down over its opening it will be seated at a level that is flush with the surface of the new coating of asphalt on the street.

The present procedures, as described above, for determining the locations of the stripings of paint and the maintenance covers on a resurfaced street are not only hazardous because of the need for crewmen to make measurements on the street when traffic is present, but they are time consuming and subject to inaccuracies which cause further delays in carrying them out. Still further, because of the expense and labor involved in the procedures, the responsibility for the work is often disputed and disregarded, resulting in the maintenance covers being sometimes left permanently covered over by the new coating of asphalt until an emergency arises which requires access to the controls beneath them.

SUMMARY OF THE INVENTION

In accordance with the present invention, a marker device is provided which comprises a base with a conical post integrally molded of an elastomeric material. The post is hollow except for its cylindrical upper end portion which is solid. The wall of the hollow portion of the post is tapered by being thicker near where it joins the base and gradually tapering to have a thinner wall adjacent the solid cylindrical upper end portion thereof. The post has a height measured from the bottom of the base that is at the most a few inches greater than the height of the new asphalt coating to be laid down on the worn down surface of the street. A slab of adhesive is provided on the bottom of the base. The adhesive substance is of the type that readily bonds to most substrates and, never hardens. For this reason, a protective heavy paper with a shiny surface covers the exposed bottom surface of the slab of adhesive until the marker device is ready to be used. Thus, to use a marker device it is necessary to first peel off the protective paper from the bottom surface of the slab of adhesive. Then, in order to mark the exact location of the striping on the surface of the worn down street, the base of a marker device with the slab of adhesive on the bottom thereof is lightly pressed down between the pair of center stripings and above each of the lane stripings on the street. The marker devices 10 are attached to the stripings every 200 feet or so along the length of the street. In order to mark the exact location of each of the maintenance covers mounted on the surface of the worn down street, the base of a marker device with the slab of adhesive thereon is lightly pressed down on the center of each of the metal surfaces of the covers. The elastomeric material of which the marker device is molded is of the type that is capable of withstanding the hot asphalt that is used to resurface the street. Moreover, the elastomeric material has a resiliency which, together with the tapered wall of the post, enables the post to have sufficient resiliency to operate properly. Thus, when the hot asphalt fed out of a feeder of a conventional paving machine is slowly advanced to cover the surface of the worn down street and, therefore, a marker device thereon, With up to two feet or so of hot asphalt, the post is caused to be bent down into a horizontal position. Then when the leveler of the paving machine strikes-off the excess hot asphalt from above the marker device down to a specified coating level which is less than the height of the post, the resiliency of the bent down-post is sufficient to immediately force it up through the coating of hot asphalt to its normal vertical position. At that time, the upper portion of the post extends above the surface of the new coating of asphalt on the street. Moreover, when any traffic passes over a marker device located on the street, either before or after the street has been provided with a new coating of asphalt, and including the tracks of the tractor for the paving machine or the wheels of vehicles, the post is caused to be bent down and flattened. However, once the traffic passes over the post, because of its resiliency, it will immediately spring back up to its normal position.

OBJECTS OF THE INVENTION

One of the objects of the present invention is to provide a marker device for use in identifying the location of paint stripings and metal maintenance covers on the surface of a street after it has been resurfaced with a fresh coating of asphalt.

Another object of the present invention is to provide a marker device for identifying the location of paint stripings and maintenance covers on a street after it has been resurfaced without having to make precise measurements which is time consuming, hazardous to carry out with traffic on the street, and subject to errors.

Another object of the present invention is to provide a marker device including a post thereon for identifying the locations of paint stripings and maintenance covers on a street wherein the marker device is molded of an elastomeric material that can withstand the hot asphalt used for resurfacing the street and also the abuse of traffic passing thereover.

Still another object of the present invention is to provide a marker device comprising a base and a post for identifying the locations of paint stripings and maintenance covers on a street after its surface is covered with a new coating of asphalt wherein an adhesive slab that instantly bonds and never hardens is used for securing the base to a paint striping on the worn down asphalt surface or to a metal maintenance cover mounted on the surface of the street.

Yet another object of the present invention is to provide a marker device for identifying the location of paint stripings and maintenance covers on the surface of a street wherein the marker device includes a post that is bent down when the hot asphalt fed by an advancing conventional paving machine is placed over it and which pops up above the coating of the hot asphalt laid down on the street when the leveler of the paving machine strikes-off the excess hot asphalt down to the level of the desired coating which is less than the normal height of the post.

These and other objects of the present invention will become more fully apparent with reference to the following specification and drawings which relate to a preferred embodiment of the present invention.

DESCRIPTION OF THE PREFERRED EMBODIMENT

Figure 1:
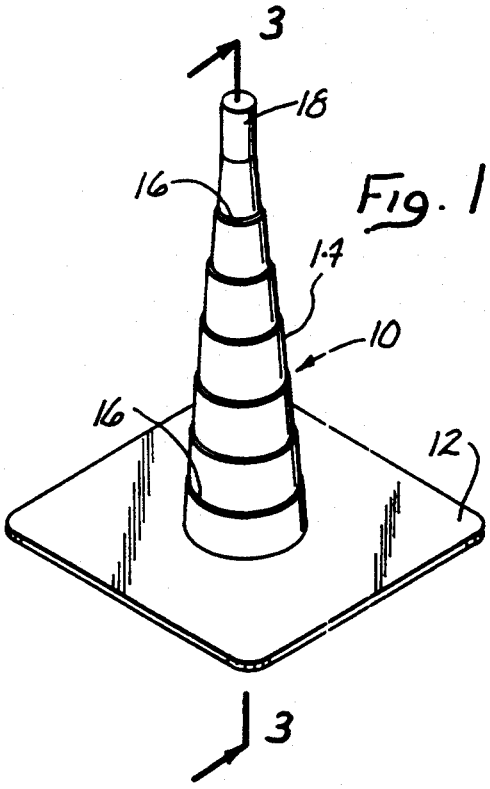
FIG. 1 is a perspective view of the marker device of the present invention.

Referring to the drawings, a perspective view of a preferred embodiment of the marker device 10 of the present invention is shown in FIG. 1. The marker device 10 is an injection molding of elastomeric material including a square base 12 having a conical post 14 extending upwardly from the center thereof. The outer conical surface of post 14 is formed with six steps 16 along the length thereof. The lowest step 16 is spaced so as to be one-half inch above the bottom of base 12, and each succeeding higher step 16 is equally spaced. The conical surface of post 14 extends one-half inch above the highest step 16 and the top one-half inch end portion 18 thereon is cylindrical in shape. Thus the post extends four inches above the bottom of base 12. As will be evident, infra, steps 16 enable the user to verify the depth of a new asphalt coating that is being laid down on the street.

Figure 3:
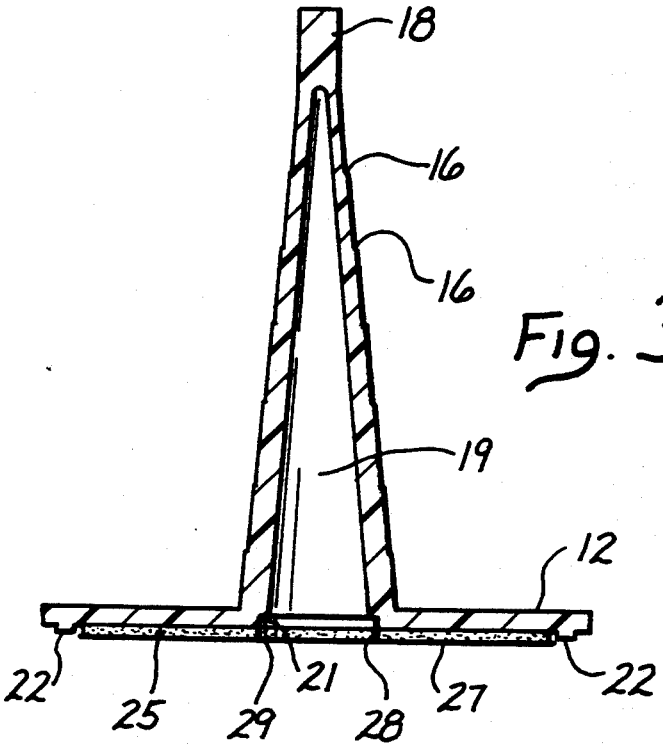
FIG. 3 is a sectional view of the assembled marker device as taken along line 3—3 of FIG. 1.

As shown in FIG. 3, which is a sectional view taken along line 3—3 of FIG. 1, only the cylindrical top end portion 18 of the conical post 14 is solid, the remaining portion 19 thereof being hollow down to the central circular opening 21 provided on the base 12. As will be apparent, infra, the top cylindrical end portion 18 of the post is made solid to prevent any hot asphalt from entering into the interior thereof during the course of laying down a new coating of asphalt on the street. Moreover, the wall of the hollow conical portion of post 14 is tapered by being made thicker near the base 12 and being uniformly narrowed toward the solid upper end cylindrical portion 18 thereof such that the thickness of the wall at the top of the hollow portion 19 is approximately two-thirds its thickness at the bottom thereof.

The elastomeric material used for injection molding the marker device 10 is a thermoplastic synthetic rubber that retains its original shape, resiliency, tensile strength and toughness when exposed to hot asphalt during the course of laying down the new coating of asphalt on a street.

Figure 2:
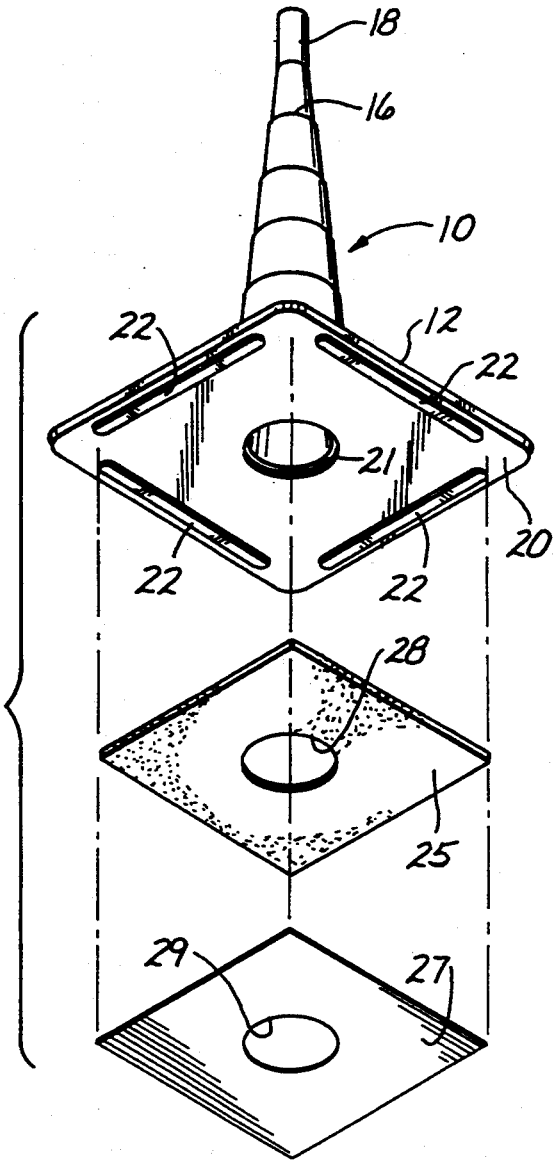
FIG. 2 is an exploded view of the components on the bottom of the base of the marker device of the present invention.
Figure 2A:
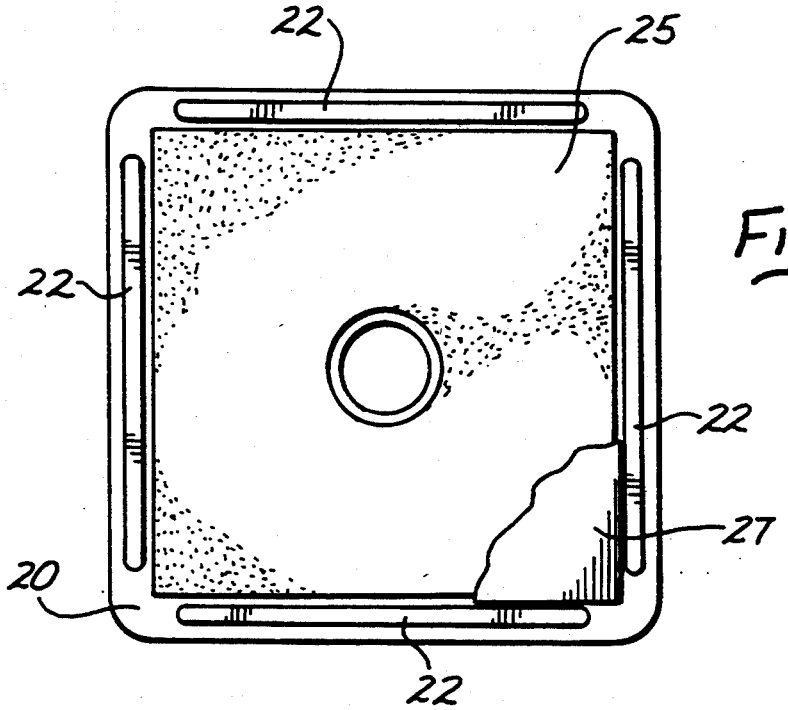
FIG. 2*a* is a bottom plan view of the base of the marker device with the slab of adhesive thereon.

Reference will next be made to FIG. 2 which shows a perspective view of the bottom 20 of the square base 12 of marker device 10. Shown exploded away from the bottom of the square base 12 is a square slab of adhesive 25 and a square sheet of protective paper 27. The bottom surface 20 of the base 12 is molded to provide an elongated narrow projection 22 inward from each of the sides thereof. The slab of adhesive 25 which is of the type that may be cut from an length of butyl tape, for example, is adhered to the bottom surface 20 of the base 12 (FIG. 2*a*) so as to reside within the confines of the side projections 22 thereon. The substance of the slab of adhesive 25 is of the type that adheres to most substrates including asphalt and metal surfaces, never hardens, will never loose its elongation or flexibility, and has exceptional resistance to temperature extremes. It is because the slab of adhesive is made of a substance that never hardens and bonds readily to most any substrate surface that the side projections 22 are provided on the bottom surface 20 of the base 22. Thus, the side projections 22 provide for confining the spreading of the soft adhesive 25 so that it can not exude outwardly from the bottom of the base 12 onto the adjacent surfaces of the asphalt or metal surfaces on which it is placed when in use. Such exuding of the adhesive onto the adjacent surface could cause the end portion of the central post 14 to adhere thereto when it is bent down and flattened by the wheels of heavy equipment or other traffic passing thereby prior to the laying down of the new coating of asphalt on the street, thus preventing the post 14 from swinging back up by its resiliency to its natural upright position.

It is also because the slab of adhesive 25 is made of a substance that bonds to most substrates and never hardens that a square piece of heavy protective paper 27 provided with a smooth shiny surface is placed over the surface of the slab of adhesive 25 to prevent it from contacting any surface until it is ready to be used. The shiny surface on the protective paper 27 makes it easier for it to be peeled off the adhesive surface when the base of the marker device 10 is to be attached on a striping on the asphalt surface or on the metal surface of a maintenance cover on a street to be resurfaced.

Figure 4:
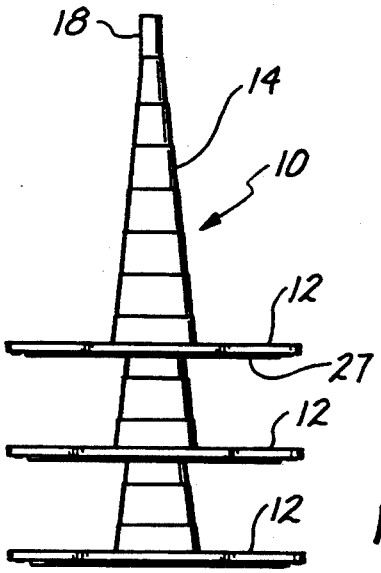
FIG. 4 is a perspective view of a plurality of marker devices stacked together.

It should be noted in FIGS. 2 and 3 that a central circular opening 28 is provided on the square slab of adhesive 25 to match the central circular opening 21 provided in the square base 12 just below the circular opening in the hollow portion 19 of the post 14. Moreover, a matching central circular opening 29 is also provided on the square sheet of protective paper 27 that is placed over the square slab of adhesive 25. This makes it possible for several marker devices 10 to be stacked together, as shown in FIG. 4, for easy handling and storage in a relatively small space with each of the respective conical posts 14 fitted within the hollow interior of the next high conical post.

It should be appreciated that when marker devices 10 are used to identify center or lane stripings on the streets, and also manhole covers and metal caps of different sizes for different types of utilities and services, in order to distinguish them from each other, each can be made of a different color by permanently compounding color into the elastromeric material at the time the marker device is molded. In this way the color of the marker device can identify the maintenance covers for the different utilities that are responsible for them.

OPERATION OF THE INVENTION

Figure 5:
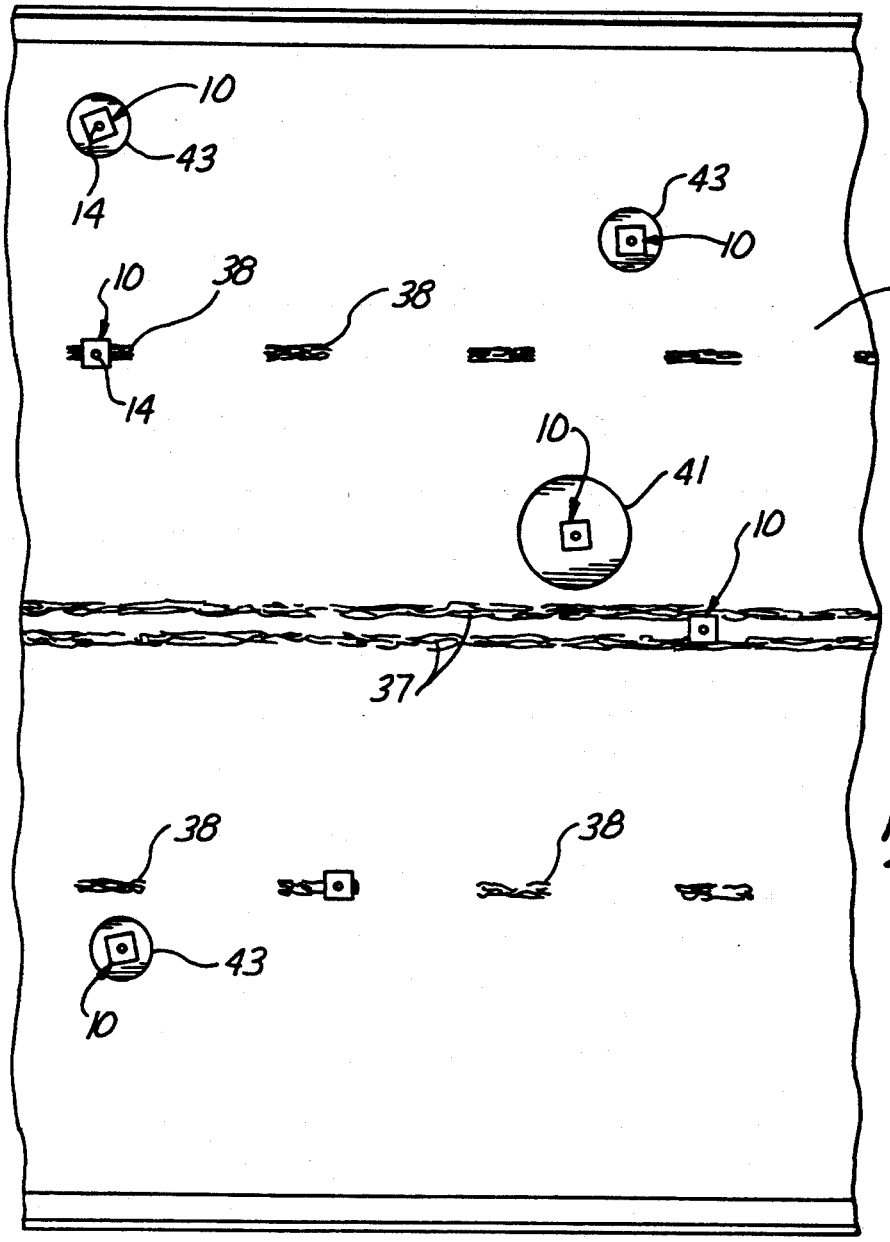
FIG. 5 is a plan view of a typical street after the surface thereof has been scraped showing the stripings for the center and lane lines and the maintenance covers thereon with a marker device of the present invention secured on each of them.

Reference will next be made to FIG. 5 which illustrates a worn down street that is provided on the surface 35 thereof with paint stripings including a pair of spaced center lines 37 and a broken line 38 at the middle of each half of the street. Also shown on one half of the street is a metal maintenance manhole cover 41 and two metal maintenance caps 43, and on the other half of the street a single metal maintenance cap 43. Each of the maintenance covers and caps is placed over the opening on the surface 35 of the street which contains controls for public utilities, for example. As is apparent, the metal maintenance manhole covers and caps are likely to be located anywhere on the street.

Prior to resurfacing a worn down street, the first thing that is usually done is scrape off any loose material on the surface thereof and roughen the surface thereof so that the new coating of asphalt can better adhere thereto. When this is done, there is always some evidence of the center and lane stripings left on the asphalt surface of the scraped worn down street, as illustrated in FIG. 5. Then a marker device 10 of the present invention which has an appropriate color is selected to designate the pair of paint stripings 37 located at the center of the street. Thus, after the protective paper 27 is peeled off the slab of adhesive 25 on the bottom of the marker device 10, the base 12 thereof is lightly pressed in place on the asphalt surface between the central paint stripings 37. Likewise, a marking device 10 of the proper color is lightly pressed in place over each of the lane lines 38 on the street. The marker devices 10 for identifying a paint striping can be placed as much as 200 feet apart from each other along the length of the street.

Next, a marker device 10 of the proper color is also placed on the center of the metal maintenance manhole cover 41 and each of the three metal maintenance caps 43 on the street.

Figure 6:
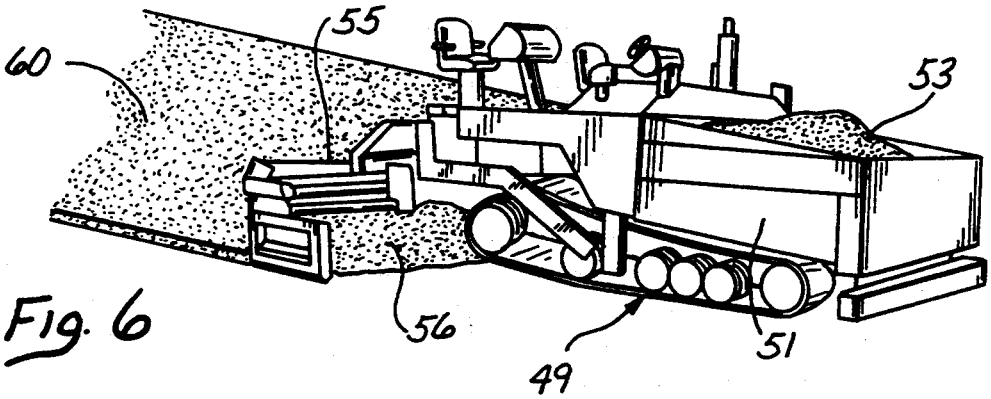
FIG. 6 is a pictorial illustration of a conventional paving machine used for resurfacing a street.

Reference will next be made to FIG. 6 which pictorially illustrates a conventional paving machine 49 which is used for resurfacing the street 35. The paving machine 49 comprises a tractor 51 provided with a bin 53 on the front end thereof in which hot asphalt is dumped by a truck (not shown). A feeder 55 for the hot asphalt which is in the form of a trough extends across the rear of the tractor 51 and is long enough to extend across one half of the street. The hot asphalt in the bin 53 is transferred to the trough on the rear of the paving machine by a moving conveyor belt (not shown) located on the bottom of the bin. The feeder trough is kept filled with the hot asphalt along the length thereof by a screw conveyor. The trough is provided with an opening along the bottom thereof from which the hot asphalt falls onto the street to form a mound 56 which is about 2 feet high and extends across half the street. The mound of hot asphalt 56 is literally pushed forward on the street by feeder 55 as paving machine 49 slowly advances therealong while permitting a controlled amount of hot asphalt on the bottom of the mound to remain on the street by use of a screed or leveler 59 (FIG. 7) provided below the feeder 55 to form the new coating of asphalt 60 on the surface 35 of the street.

Figure 7:
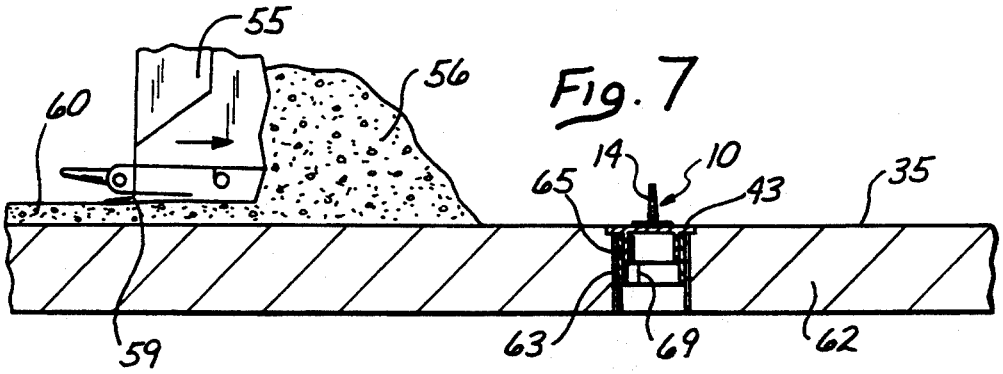
FIG. 7 diagrammatically illustrates the feeder of an advancing conventional paving machine pushing a mound of hot asphalt along the street while laying down a new coating of asphalt on the street as it approaches a marker device held on the top of a metal maintenance cap mounted on the street.

Reference will next be made to FIG. 7 which illustrates the feeder 55 on the paving machine 49 approaching a marker device 10 that was previously placed on the top of a metal maintenance cap 43 mounted on the surface 35 of the street. It should be noted in FIG. 7 that the opening on the street that is covered by the maintenance cap 43 is formed by mounting a metal cylindrical member 63 in the base 62 of the street. An adjustable cylindrical member 65 formed of a length of resilient sheet steel shaped to normally have a larger diameter than cylindrical-member 63 with its ends 69 overlapping is held within the cylindrical member 63 at a height so that when the metal maintenance cap 43 is seated on the upper edge thereof it will be level with the surface 35 of the street.

Figure 8:
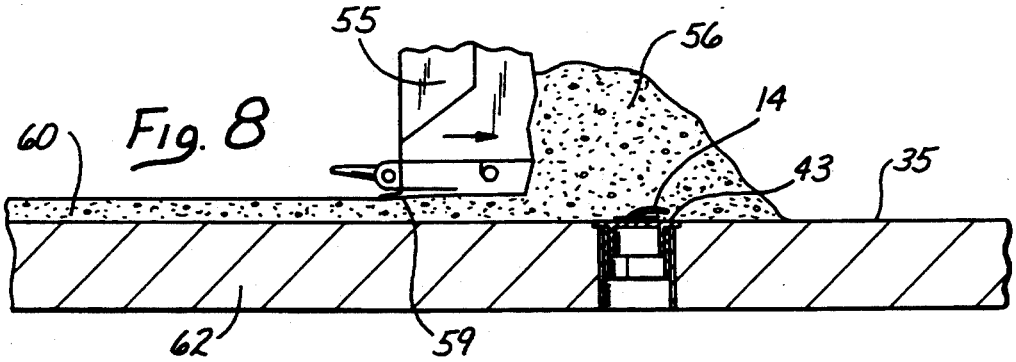
FIG. 8 diagrammatically illustrates the feeder of the conventional paving machine pushing the mound of hot asphalt over the marker device on the street.

FIG. 8 illustrates the hot asphalt feeder 55 of the paving machine 49 advanced along the surface of the street so that the 2 foot high mound 56 of hot asphalt now lies over the marker device 10 at which time the post 14 thereon has been pushed down by the advancing mound 56 of hot asphalt and the weight thereof so as to be substantially flush with the surface of the metal maintenance cap 43.

Figure 9:
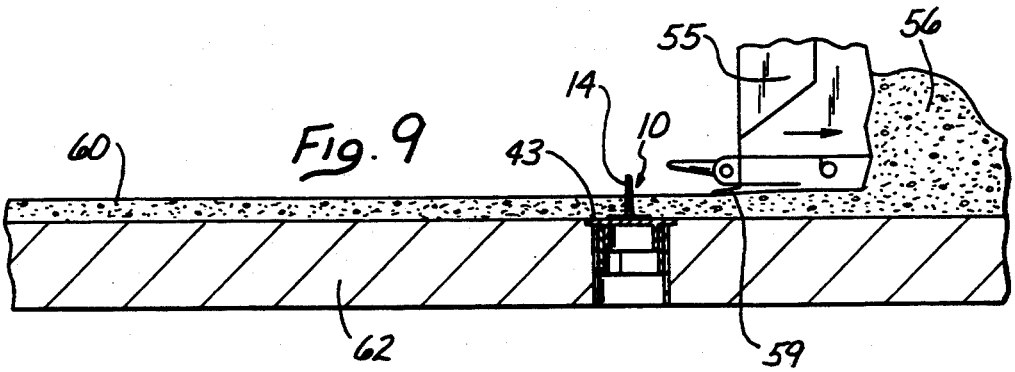
FIG. 9 diagrammatically illustrates the feeder of the conventional paving machine pushing the mound of hot asphalt past the marker device on the street.
Figure 10:
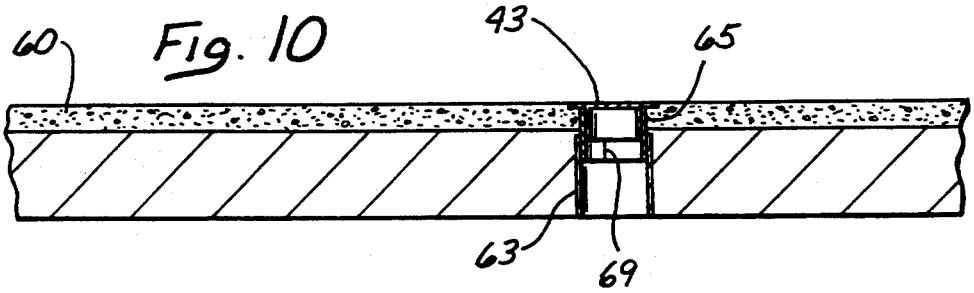
FIG. 10 is a cross sectional showing of the maintenance cap after the asphalt has been removed from the top thereof and it has been raised to the level of the new coating of asphalt on the street.

FIG. 9 illustrates the asphalt feeder 55 of the paving machine 49 after it has further advanced along the surface 35 of the street just past the marker device 10 wherein the leveler 59 has reduced the level of the new coating of hot asphalt being laid on the street below the normal height of the conical post 14 of the marker device 10. This enables the post 14, because of its resiliency, to force its way back from its deformed position to its normal vertical position with its upper portion extending above the surface of the new coating 60 of asphalt.

It should be appreciated that once the new coating 60 of hot asphalt has been laid down, a roller, (not shown) is advanced over the new coating 60 which further compresses the hot asphalt by as much as ¼ inch for each inch of the hot asphalt initially forming the new coating. Moreover, when this roller passes over the marker device 10, it flattens down the exposed upper end portion of the post 14 but as soon as the roller passes by the marker device 10, the exposed upper end portion of the post 14 springs back up to its normal vertical position.

It should be noted in FIG. 9 that the metal maintenance cap 43 that is placed over the opening on the old surface of the street is now located below the surface of the new coating 60 of asphalt making-the maintenance cap 43 and the controls located therebelow inaccessible. Thus, as is well known in the art, it is necessary to remove the asphalt above the metal cover by use of a shovel, if done while the hot asphalt has not yet hardened, or by use of a pick ax if the hot asphalt has hardened. Once the metal maintenance cap 43 is removed from over the opening in the street, the adjustable cylindrical member 65 provided in the opening, is adjusted upwardly by squeezing the opposite diametrical sides of the adjustable cylindrical member 65 together to temporarily reduce its diameter. This frees the adjustable cylindrical member 65 so that it can be adjusted upwardly to a level at which it can now seat the metal cap 43 so that its top surface is now flush with the upper surface of the new coating 60 of asphalt. At the time the asphalt is removed from the top of the metal maintenance cap 43, the marker device 10 is usually also removed therefrom since it is no longer needed.

If for any reason the marker devices 10 are left on the street after it is resurfaced and the metal maintenance covers and caps are not adjusted to be seated flush with the surface of the new coating on the street, the traffic can runover the exposed upper end portions of the posts and cause them to be flattened but, because of their resiliency, after the traffic passes, the posts jump back to their normal vertical position. The posts of the marker devices 10 can withstand such abuse for as much as a year or longer before they wear away and are no longer able to identify the locations of the metal maintenance covers embedded in the resurfaced street.

Also, the exposed posts 14 on the marker devices 10 provided for identifying the locations of the center paint stripings 37 and the lane paint stripings 38 on the street 35 enable crewmen to paint new center and lane stripings on the street without having to make new measurements. After the stripings are painted, the marker device 10 used for identifying their locations on the street can be cut down so that they are flush with the resurfaced street or they can be removed by digging up the asphalt that covers their bases.

While the invention has been illustrated and described in detail in the drawings and foregoing description, the same is considered to be illustrative and not restrictive in character, it being understood that only the preferred embodiment has been shown and described and that many changes and modifications may be provided for without departing from the spirit and scope of the invention or sacrificing any of its advantages and the invention is, therefore, considered to be limited only as indicated by the scope and spirit of the appended claims.

What is claimed is:

1. A method of identifying the locations of maintenance covers and paint stripings on a street after the surface thereof has been paved with a new coating of hot molten paving material, said method comprising the steps of:

attaching a marker device having an upright post formed of an elastomeric material on each of the covers and at spaced distances along each of the paint stripings;

advancing a mound of hot molten paving material in a continuous manner along the street to overlie the street and the marker devices in place on the covers and paint stripings and causing the upright posts of the marker devices to be bent down by the weight of the mound of paving material;

permitting only the lower portion of the advancing mound of paving material adjacent the street to remain thereon as the new coating of paving material, subsequently permitting the bent down posts to return up through the coating of molten paving material to their upright positions; and visually sighting the exposed upper end portions of the upright posts in the coating of paving material.

2. A marker device for placing on maintenance covers and paint stripings provided on a street to identify the locations thereof after the street is paved with a coating of hot molten paving material, said marker device comprising:

a molding of elastomeric material including a planar base having a bottom surface and a post having a hollow conical body extending upwardly from the center of the planar base, said hollow conical body having a solid upper end on the top thereof;

said hollow conical body of the post formed with a tapered wall wherein the diameter of the tapered wall is thicker at the bottom thereof adjacent the planar base and is gradually thinner toward the top thereof, thereby decreasing the volume of the elastomeric material along the height from the bottom to the top thereof and thereby decreasing the resilience and increasing the flexibility of the conical post from the bottom to the top thereof; and said planar base having on the bottom surface thereof a slab of elastic adhesive.

3. A marker device as claimed in claim 2 wherein steps are molded on the outer surface of the tapered wall of the hollow conical body of the post at fixed distances along the length thereof.

4. A marker device as defined in claim 2 wherein the thickness of the conical wall at the top of the hollow conical body is approximately two-thirds the thickness at the bottom thereof.

5. A marker device as defined in claim 2 wherein said post when in its upright position extends on the order of 4 to 6 inches above the bottom surface of the planar base.

6. A marker device as claimed in claim 2 wherein the elastomeric material used for molding the marker device is a composition that retains its ability to recover to its original shape after being deformed, its resiliency, and its flexibility when exposed to molten paving material having a temperature on the order of 300° F.

7. A marker device for use in identifying the locations of maintenance covers and paint stripings on a street after the surface thereof has been paved with a coating of molten paving material being provided by an advancing paving machine that is pulling a mound of the molten paving material along the street followed by a screed on the paving machine that serves to permit only the portion of the advancing mound of molten paving material adjacent the street to remain thereon as the coating of molten paving material, said marker device comprising:

a molding of elastomeric material including a planar base and a post extending upwardly therefrom;

said post formed along the height thereof with a cross-sectional area of elastomeric material that gradually reduces in size from the bottom thereof adjacent the planar base toward the top thereof, whereby the volume of the elastomeric material forming the post gradually decreases at successive points from the bottom to the top thereof, thereby gradually decreasing the resilience and increasing the flexibility of the post at successive points along the post from the bottom to the top thereof;

one of said marker devices being attached by its planar base to each of the maintenance covers and at spaced locations along each of the paint stripings, and each of the posts of the marker device including means relating to their resiliency and flexibility at each point along the length thereof for permitting said poses to be bent down by the weight of the mound of molten paving material and when only the coating of molten paving material is left on the street each of the posts because of the resiliency and flexibility at each point along the length thereof is able to move up through the coating of molten paving material because of the reducing of the weight of the coating of paving material thereover to its upright position in which it is visible above the surface thereof thus serving to identify the location of each of the maintenance covers and paint stripings on the paved street.

* * * * *